US005861060A

United States Patent [19]

Maugans et al.

[11] Patent Number: 5,861,060

[45] Date of Patent: Jan. 19, 1999

[54] SUPPLY TANK FOR ELECTROSTATIC SPRAYING SYSTEM

[75] Inventors: James R. Maugans, Newport Beach, Calif.; Kevin J. Knight, Bolingbrook; Paul Flint, Oak Park, both of Ill.

[73] Assignee: Binks Sames Corporation, Franklin Park, Ill.

[21] Appl. No.: 583,653

[22] Filed: Jan. 11, 1996

[51] Int. Cl.[6] ..... B05B 5/00

[52] U.S. Cl. ..... 118/50.1; 118/621; 118/300; 239/690; 239/706; 239/708

[58] Field of Search ..... 118/50.1, 50; 239/690, 239/690.1, 3, 706; 361/215, 227

[56] References Cited

U.S. PATENT DOCUMENTS

| | | | |
|---|---|---|---|
| 3,892,357 | 7/1975 | Tammy | 118/629 |
| 5,335,854 | 8/1994 | Seitz et al. | 239/146 |
| 5,487,782 | 1/1996 | Seewaldt | 118/621 |

FOREIGN PATENT DOCUMENTS 4223819 1/1994 Germany .

*Primary Examiner*—Donald E. Czaja
*Assistant Examiner*—Calvin Padgett
*Attorney, Agent, or Firm*—Wallenstein & Wagner, Ltd.

[57] ABSTRACT

A grounded insulated electrostatic supply tank comprised of a conductive tank that has several liners to fully insulate a waterborn fluid in the tank from ground. The interior of the tank and a sealed lid are coated with an insulating liner. An intermediate lining is placed in the tank and third interior insulating inner liner is inserted in the tank and has a lip that wraps around the upper rim of the tank and is sealed between the lid and the tank. Electrostatic spray equipment is connected to the tank by a coaxial hose having an inner non-conductive hose and preferably, an outer hose that is conductive. Inner non-conductive hose extends through the lid into an insulating teflon pick-up tube that extends to near the bottom of the tank. Depleted waterborn fluid in the tank is grounded after use by a manual probe or by a piston operated automatic grounding system.

20 Claims, 5 Drawing Sheets

SUPPLY TANK FOR ELECTROSTATIC SPRAYING SYSTEM

BACKGROUND OF THE INVENTION

1. Field of the Invention

This invention relates to fluid supplies for electrostatic spray systems and more particularly, relates to a grounded insulated fluid supply.

2. Background Information

A recent increase in the use of waterborn coatings, sprayed electrostatically, has created interest in providing protection against shock hazards. Previously, when spraying waterborn coating electrostatically, the supply tank for the coating, which is normally quite conductive, is isolated from ground with electrical insulators. This is achieved by supporting the supply tank on electrical insulators of sufficient insulation values to assure high voltage is maintained to the electrostatic spray device. In these systems the support tank, as well as the supporting platform, are carried at high voltage which can create shock hazards.

To provide safety for personnel operating such systems, the supply is then often enclosed in a grounded and fenced area that typically has a gate opening that is interlocked so that the supply is automatically grounded if the gate is open. This arrangement requires substantial additional floor space in the spray area necessitating high initial costs for materials, installation and maintenance. Also, the system must frequently be checked to ensure proper operation.

Operation of electrostatic spraying systems typically range in voltage outputs from 60,000 to 100,000 volts DC depending upon the type, and whether they are manual or automatic. The electrical capacitance of such operating systems can be quite high and undesirable.

These problems have generated substantial interest in making the system more simple and safe by using voltage blocking systems. These voltage blocking systems provide protection from shock hazards which present serious problems because waterborn coatings are such good conductors of electricity. The charge applied to these coatings feeds back through the paint stream and electrifies the paint equipment. The most common safety strategy, as described above, is to place the paint supply equipment on insulated stands and isolate them from ground. Building safety cages around the equipment so no one is able to come into contact while it is charged is another step toward safety.

In recent years, paint equipment and other fluids spray suppliers have developed voltage blockers to cope with this problem. Each use different designs and concepts that vary, but all seem to achieve the same goal which is to create an air gap in the fluid stream to prevent the flow of electricity between electrostatic spray device and the paint supply.

One such voltage blocker called the Side Kick Voltage Blocker, manufactured by Binks Manufacturing, Inc., offers a computer-controlled voltage block. The Position between the spray device and the grounded material supply are isolated to progressively block the electrostatically charged reservoir or supply tank from ground. This system provides protection by moving a fixed volume of waterborn paint from isolator to isolator and finally into the electrostatically charged reservoir. Each isolator tube is scraped and cleaned as it transfers paint, thereby creating a voltage block. The system continuously fills and maintains a fluid level in the reservoir as paint is being sprayed.

Another system, manufactured by Graco Inc. of Minneapolis, Minn. called the $H_2O$ Pro Voltage Blocker, uses voltage blocking designed around an isolator that supplies paint to an accumulator. The isolator houses a valve that alternately opens to allow paint to fill the accumulator and then closes to provide electrical separation between charged fluid and grounded equipment. The system also features an arc reduction probe on the isolator that protects the wiping rod from arcing and a bleed resistor that drains voltage from the system when the gun is not use. The system also includes a pump that circulates lubricant seals in the isolator, a push-button flushing activator and a grounded metal enclosure that eliminates static discharge.

Another system called the Aqua Block System, available from ITW Ransburg Electrostatic Systems of Toledo, Ohio is comprised of three basic elements. These elements are a rotary four-way purging valve, a cylinder/reservoir and a circulating supply of "blocking media." The fluid supplied to the spraying apparatus enters one port of the four-way valve and is alternately switched from one or the other of the valve to the port at each end of the cylinder/reservoir. The cylinder/reservoir is a double-ended piston assembly that is driven by the flow of fluid through the system to the spraying equipment. The continuous flow of blocking medium purges any conductive fluids that escape as the valve actuates, providing electrical isolation inside the four-way valve.

Another system called the Iso-Flo Voltage Blocker from Nordson Corporation of Amherst, Ohio employs voltage blocking designed to work with nearly all internal and external power supply guns, atomizers and discs. In this system, an electrostatic power unit is located just outside the spray booth to supply the electrostatic charge to the coating material. This charging method eliminates the need for individual power supplies and electrostatic cables from multiple spray devices. The system features single-stage, pneumatically operated reservoirs that alternately fill and spray to ensure a continuous supply of coating material. During operation, shuttle valves alternately connect the reservoirs to the grounded paint supply source and to the charge spray devices. The shuttle valves provide the air gap to provide the voltage blocking or electrical isolation between the charged coating and any grounded material or equipment.

While the above systems may be effective, they are complicated and expensive to fill and use, requiring a great deal of maintenance and many parts. It would be advantageous if a system could be designed and operated effectively in which the supply tank is grounded and insulated for use with a conductive coating contained within the tank. Such a system would void all the disadvantages of electrostatic application of waterborn coatings and those of the present complex isolation systems described above.

It is therefore, one object of the present invention to provide a grounded insulated supply tank for electrostatic application of waterborn coatings.

Still another object of the present invention is to provide a grounded insulated supply tank for use in electrostatic application of waterborn coatings that will minimize the amount of floor space required.

Yet another object of the present invention is to provide a grounded insulated fluid supply that is simple and easy to use, and substantially reduces installation costs.

Still another object of the present invention is to provide a grounded insulated supply tank for electrostatic application of waterborn coatings that has a conductive tank with a insulated liner and a non-conductive pick-up tube that is attached to the fluid output of the supply tank cover and extends to the bottom of the inner most insulating liner.

Still another object of the present invention is to provide a grounded insulated supply tank for use in electrostatic application of waterborn coatings including a non-conductive fluid hose connected to an insulating fluid pick-up tube in the fluid tank. The non-conductive fluid hose may have a conductive outer cover to ground the system in the event of hose rupture and offers abrasion protection in use.

Still another object of the present invention is to provide a grounded insulated supply tank for electrostatic application of waterborn coatings that has multiple insulating liners, an insulated cover on top of the insulating liners in addition to an insulating pick-up tube that isolates the electrically conductive waterborn coatings from the conductive tank, allowing the tank to be grounded.

Yet another object of the present invention is to provide grounded insulated supply tank for electrostatic application of waterborn coatings that includes a grounding probe to ground the electrically conductive fluid when fluid in the tank is depleted.

Still another object of the present invention is to provide a grounded insulated supply tank for electrostatic application of waterborn coatings that include an automatic grounding system when the tank is empty and tank pressure is released.

Still another object of the present invention is to provide a grounded insulated supply tank for electrostatic application of waterborn coatings having a grounding system including a piston that is lifted when the tank is pressurized and is released by removing pressure when the tank is empty to automatically ground the electrically conductive fluid.

BRIEF DESCRIPTION OF THE INVENTION

The above and other novel features of the invention will be more fully understood from the following detailed description and the accompanying drawings, in which:

DETAILED DESCRIPTION OF THE INVENTION

Figure 1:
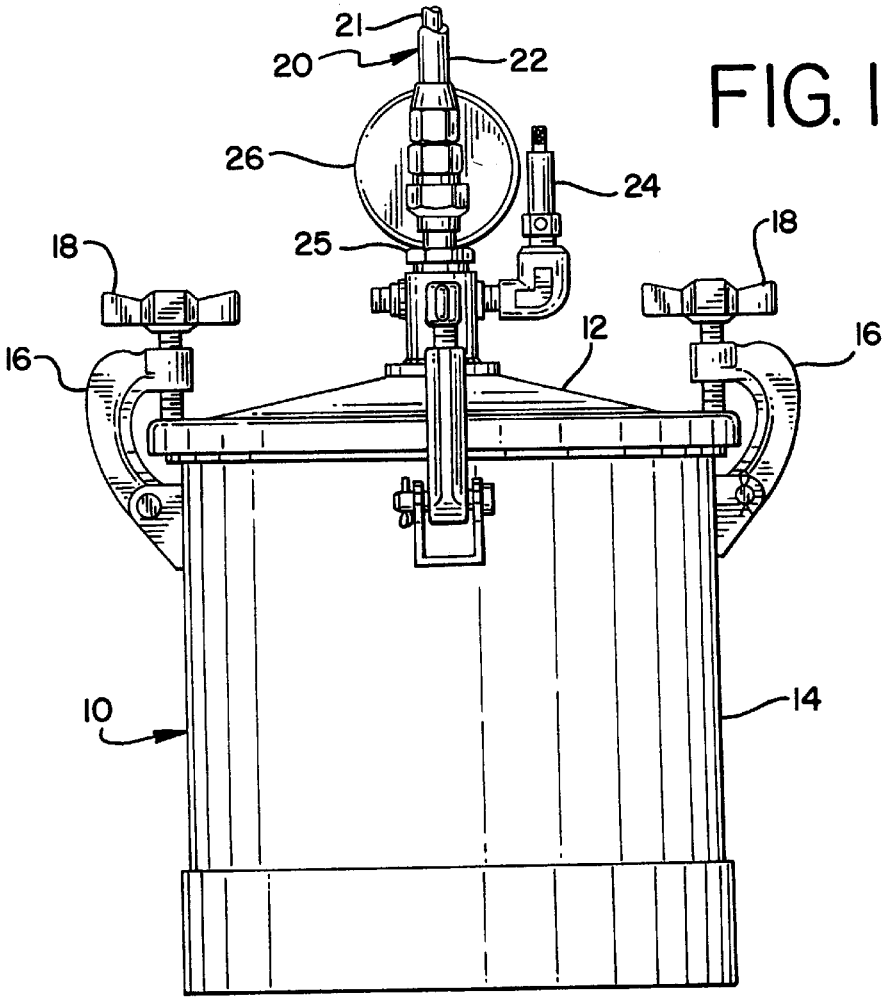
FIG. 1 is a side elevation of a supply tank for use with an electrostatic application of waterborn coatings.
Figure 2:
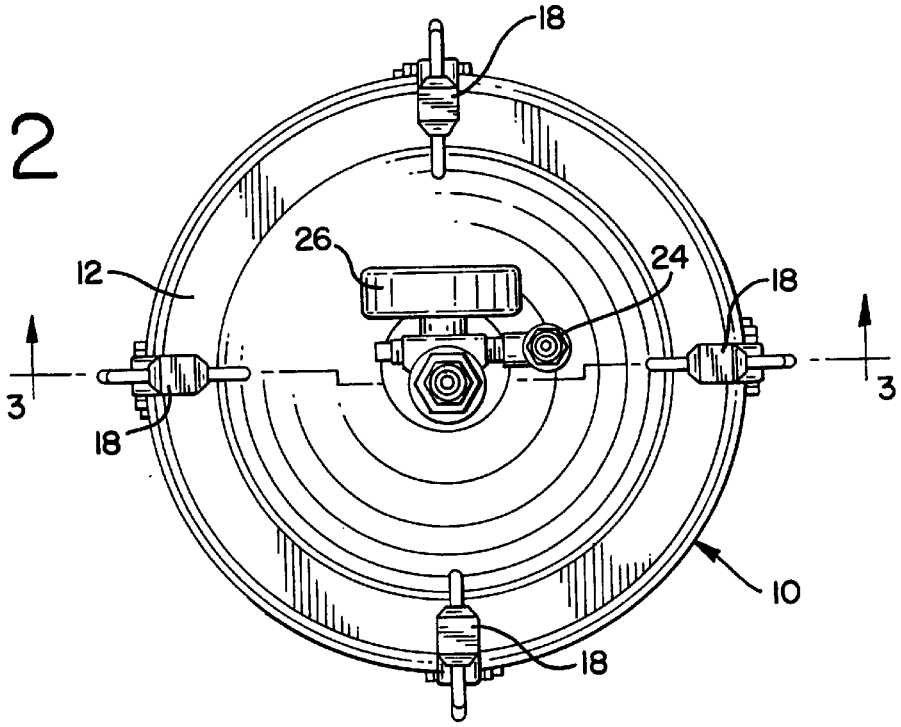
FIG. 2 is a top view of the supply tank of FIG. 1.

A grounded insulating supply tank 10 for electrostatic application of waterborn fluids is illustrated in FIG. 1. Grounded supply tank 10 is typically constructed of a conductive material and has a conductive lid 12 constructed to be securely clamped on the tank 14 by clamps 16, having thumbscrews 18 for cinching lid 12 on tank 14. Fluid is drawn from the tank through a non-conductive fluid hose 20 for delivery to spraying equipment (not shown). Preferably, non-conductive hose 20 has a conductive outer cover 22 to ground the system in the event of rupture of non-conductive hose 21 and to provide protection against abrasion in use.

A standard hose connection or air inlet valve 24 is provided to apply pressure to the tank that is metered by gauge 26.

A conductive fluid 65, for electrostatic application, is supplied through coaxial hose 20 having an inner non-conductive fluid hose 21. Preferably, outer cover 22 is conductive to ground the system in the event of rupture of inner non-conductive hose 21 and to offer abrasion protection in use. Fluid hose 20 is connected to tank cover 10 by an adaptor bushing 25.

Figure 3:
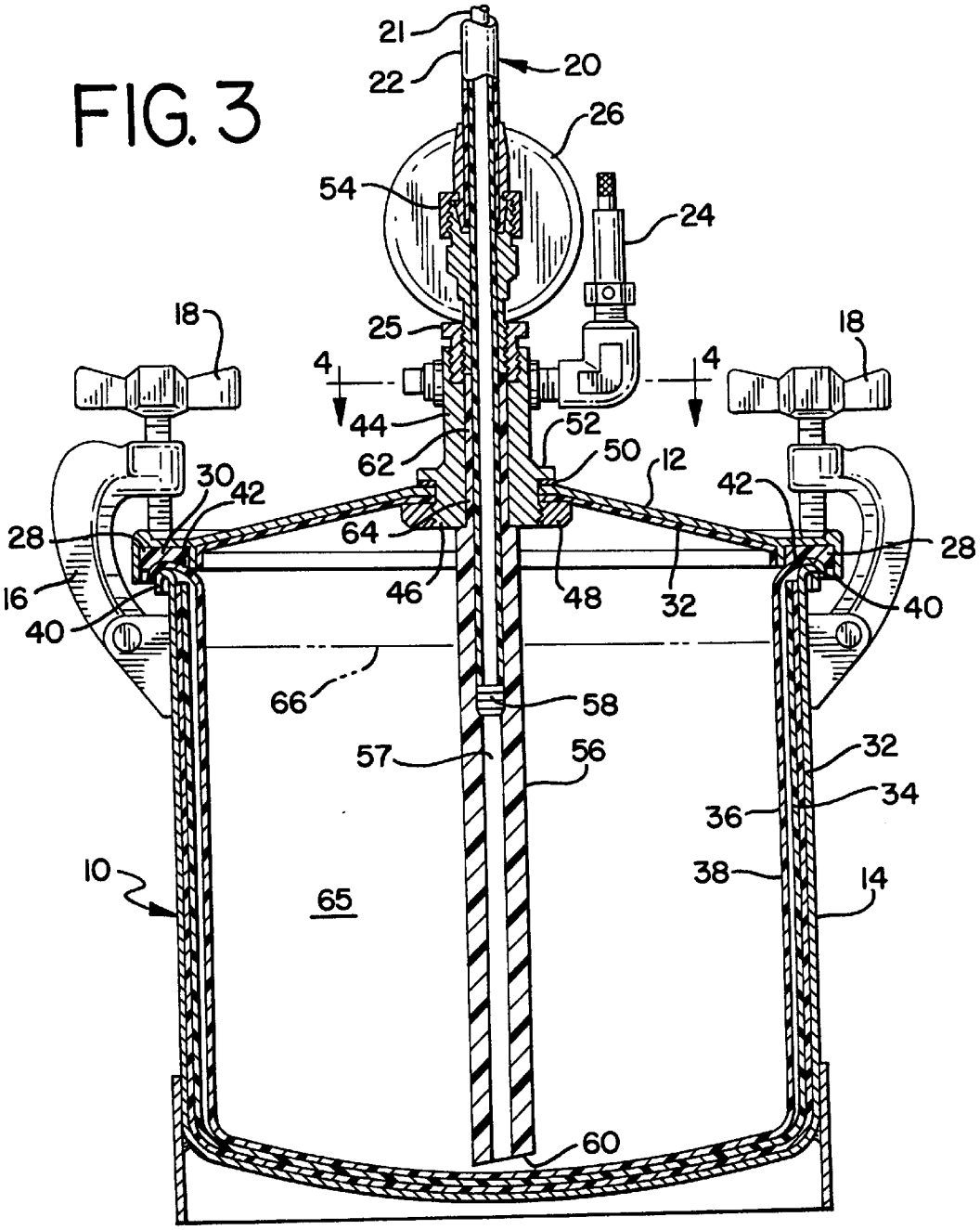
FIG. 3 is a sectional view taken at 3—3 of FIG. 2.
Figure 4:
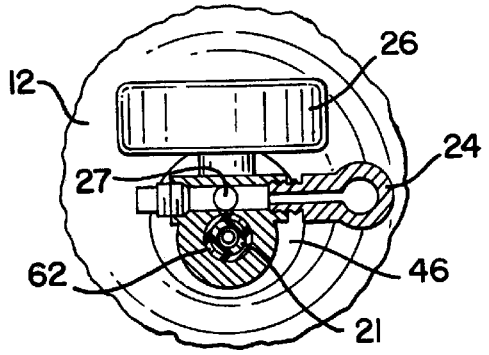
FIG. 4 is a sectional view taken at 4—4 of FIG. 3.

The insulation of the tank is illustrated in greater detail in the sectional view of FIG. 3. Tank lid 12 has a peripheral annulus 28 having a rubberized seal 30 to completely seal the tank to allow the tank to be pressurized after securely cinching lid 12 down with clamps 16. The inner surface of lid 12 and tank 14 are insulated with a powder coating material 32. Preferably, tank 14 is a standard two gallon pressure tank having an insulated powder coated lid 12 and powder coated interior 32 to provide additional electrical insulation and corrosion protection. The insulating coating can be any suitable material such as teflon or some other insulating coating.

To provide additional insulation, a pair of tank liners comprised of intermediate liner 34 and inner liner 36 provide additional insulation for the electrostatic fluid. Intermediate liner 34 is any suitable plastic material which fits tightly in tank 14 against insulating coating 32.

Inner liner 36 is comprised of an insulating plastic container set in tank 14 and constructed to provide an air space 38 between insulating intermediate liner 32 and insulating inner liner 36. The combination of the multiple insulating materials and air space 36 provide substantial insulation to electrostatic fluid 65 filling tank 14.

Preferably, inner liner insert 36 extends to the top of tank 14 and wraps at 42 around upper edge or rim 40 of tank 14. Thus, inner insulating liner insert 36 is securely clamped beneath rubberized insulator 30 on tank lid 12 and rim 40 of tank 14.

Tank connector 44 has a threaded boss 46 for securing the connector to lid 12 with nut 48 sealed by resilient washer 50 beneath flange 52. Hose 20 is connected to tank connector 44 by adaptor bushing 25 and fitting 54. Inner non-conductive fluid hose 21 extends through fitting 54, adaptor bushing 25 into non-conductive tube 56 preferably made of teflon or a similar material. Gland 58 on the end of non-conductive fluid hose 21 extends well down below lid 12 into passageway 57 of teflon pick-up tube 56.

Teflon pick-up tube 56 extends from oblique end 60 positioned close to the bottom of tank 14 and has a tubular extension 62 seated in bore 64 in tank connector 44. Thus, a waterborn fluid 65 in supply tank 14 is completely insulated from the outer shell of the tank which is grounded.

This system will provide excellent electrical insulation for a standard two gallon pressure tank having an insulating coating 32 on lid 12 and the interior of tank 14. The interior insulating inner liner container or insert 36 is placed in the tank and filled with waterborn fluid 65 to an inch or two of the top of the container indicated at 66. The special plastic or teflon insulated pick-up tube 56 is sized to receive the non-conducting hose 21 of coaxial teflon fluid hose 20 that has a standard gun-end fitting (not shown) on both ends. Non-conductive tube includes a gland 58 in the interior bore 57 of teflon pick-up tube 56 having a O-ring seal that completely isolates waterborn coating material of fluid 65 from ground inside the tank 14 to the tip of spray gun (not shown). This system may be safely used for electrostatic spraying of waterborn coatings from an externally grounded pressure tank 14. This system can also be used with virtually any size pressure tank and may be modified to accommodate outlet locations, etc. With the supply tank 10 completely insulated from ground, any electrical charge on the waterborn material 65 in tank 14 is slowly bled off through fluid hose 20 to the gun and back to the high voltage power supply circuitry and ground. Any residual or electrical charge can be quickly eliminated by two methods which will be described in greater detail hereinafter.

Pressure is supplied through quick connect fitting 24 to aperture 27 in boss 46 on tank connector 44. Pressure applied to fitting 24 passes through aperture 27 in boss 46 into tank forcing waterborn fluid or material 65 up into bore 57 of insulating pick-up tube 56.

Figure 5:
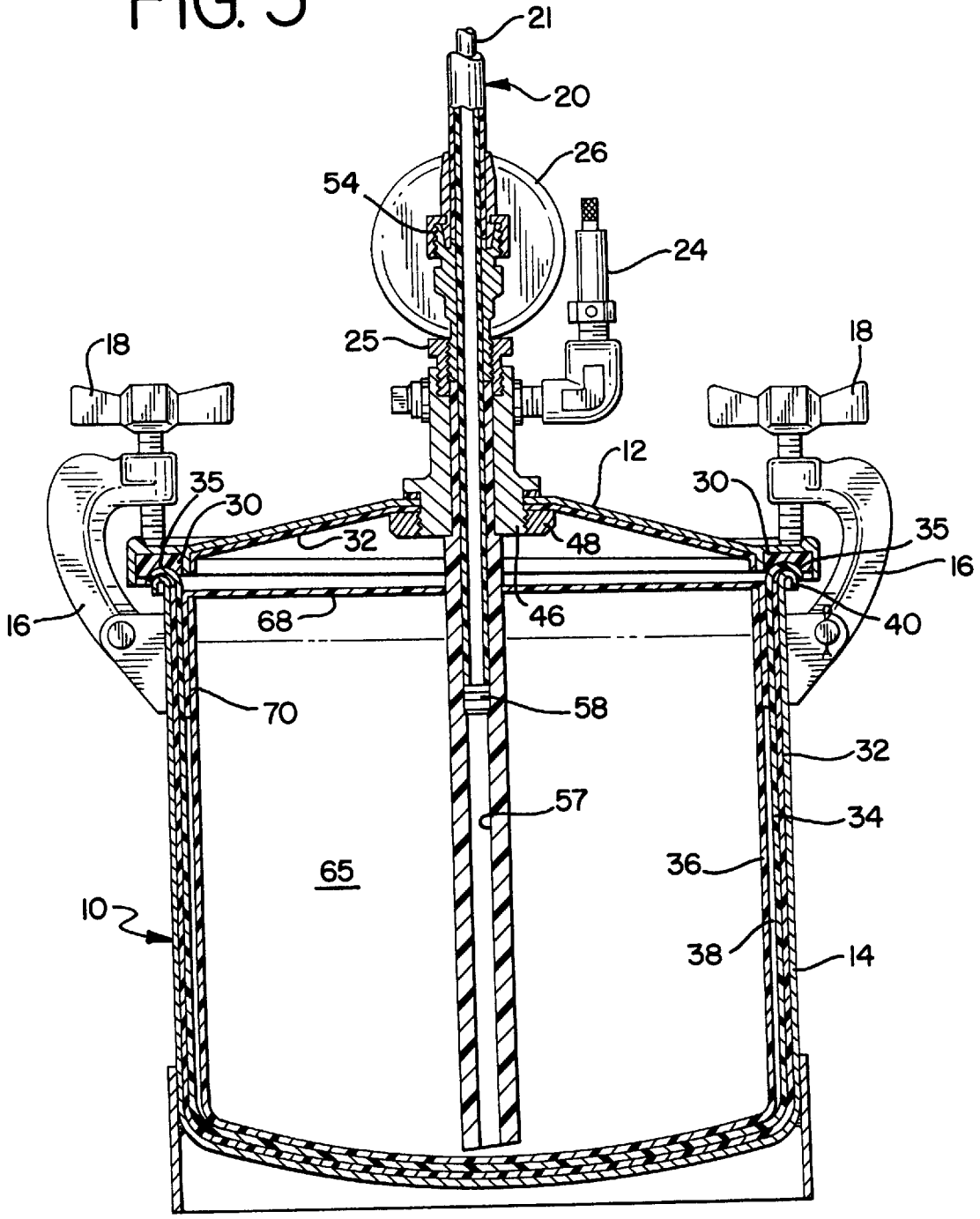
FIG. 5 is a sectional view similar to FIG. 3 showing an alternate embodiment.

An optional embodiment is illustrated in FIG. 5 in which an interior insulating lid 68 is provided. In this embodiment, intermediate liner 34 wraps at 35 around rim 40 of tank 14. This securely clamps intermediate liner 34 between seal 30 around the periphery of lid 35. Inner liner 36 has the same air space 38 and stops slightly short of the top of tank 14. This allows insulating lid 68 having skirt 70 to fit into the air space 38 between inner liner 36 and intermediate liner 34 providing additional insulation for the waterborn material or fluid.

Figure 6:
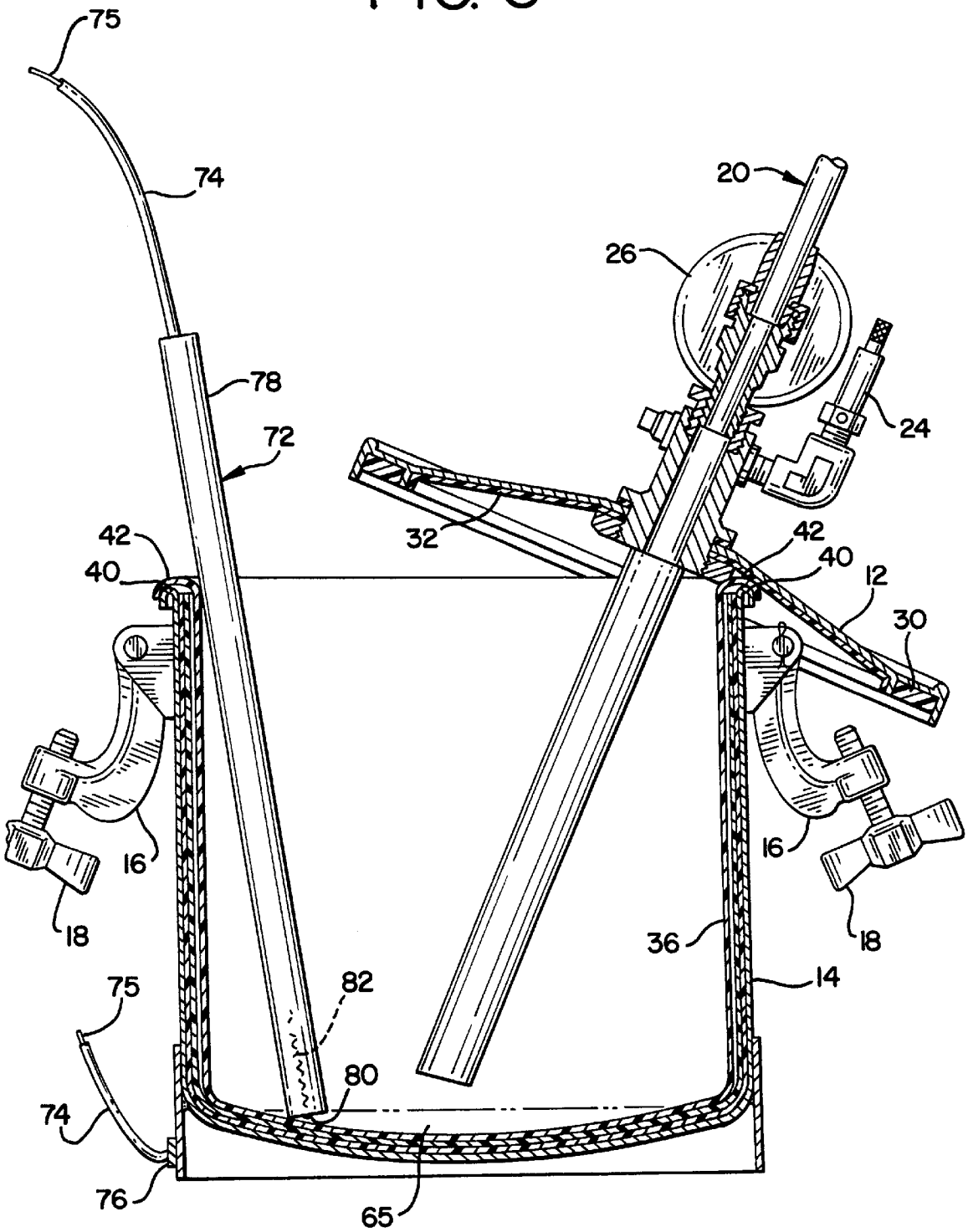
FIG. 6 is a sectional view with the lid of the tank removed illustrating the use of a grounding probe to ground the remaining conductive fluid in the tank before refilling.

As previously described, a residual charge may remain in waterborn fluid 65 which can be slowly bled off through the fluid hose to the gun and back to the high voltage power supply circuit and ground. However, the charge may be quickly eliminated by the methods illustrated in FIGS. 6 and 7. In the embodiment of FIG. 6, a probe 72 having a conductor 74 is provided that is grounded to the tank at 76. Handle 78 on probe 72 is insulated as is grounded conductor 74. After the waterborn fluid 65 is depleted in tank 14, lid 12 is removed and probe 78 is dipped into waterborn fluid 65 so that conductive top 80 touches the fluid. A solid conductive wire 75 can be used to provide the contact at end 80. However, a fairly large spark can be generated when waterborn material 65 is grounded. This arc can be eliminated by adding a 160 megohms resistor 82 in probe 72 to limit the steady-state current flow and eliminate any arc or sparking. Thus, to eliminate any residual charge in waterborn fluid 65, the operator simply touches the fluid with probe 72 grounded to tank 14 to dissipate the charge.

Figure 7:
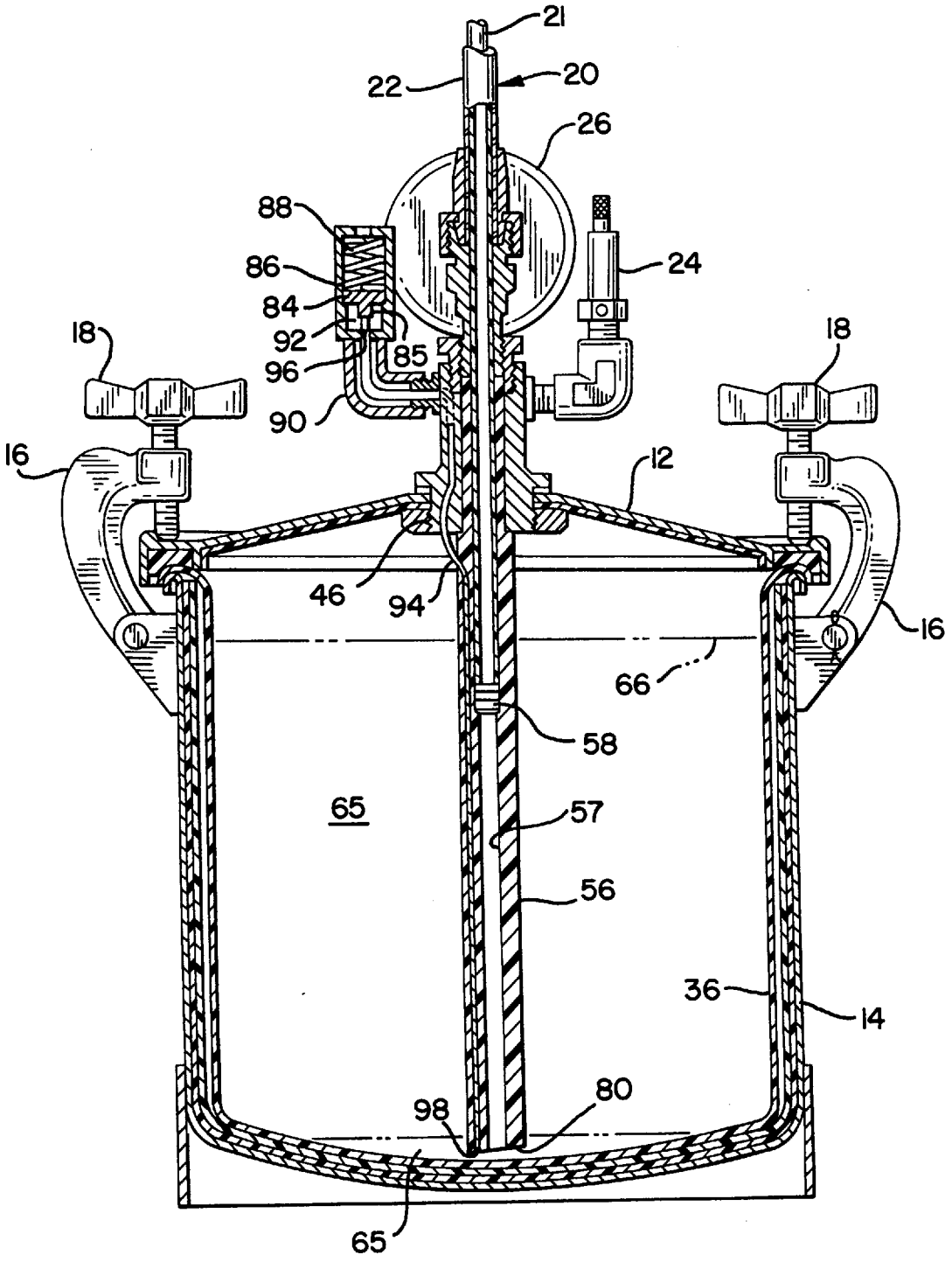
FIG. 7 is a sectional view similar to FIG. 3 showing an alternate embodiment of an automatic grounding system when the fluid in the tank has been nearly been completely dispensed.

Another device is provided, as shown in FIG. 7 which will provide automatic grounding without removal of lid 12. In this embodiment, a piston 84 in cylinder 86 is powered by pressure applied to the tank through quick connect fitting 24. Pressure applied to fitting 84 pushes piston 84 back against the biasing force of coil spring 88 in cylinder 86. Pressure flows through elbow 90 to chamber 92 in cylinder 86. A conductor 94 passes from a terminal 96 at the end of chamber 92 through boss 46 into teflon pick-up tube 56 and terminates at terminal 98 at the lowest end of pick-up tube end 80.

When pressure is released from fitting 24, spring 88 biases piston 84 so that post 85 contacts terminal 96 grounding any remaining waterborn fluid 65 in tank 14. If desired, a resistor as previously described can also be included in the path of conductor 94 to prevent arcing.

The system of FIG. 7 in use, is filled to a level indicated at 66 about an inch or two from the top of inner liner 36. The waterborn material 65 is then applied using electrostatic applicator (not shown) until fluid 65 is substantially depleted to near the bottom of tank 14. When the waterborn fluid is depleted, pressure is removed from fitting 24 and piston 84 grounds conductor 94 dissipating any residual charge.

Thus, there has been disclosed a unique grounded insulated electrostatic supply tank. The supply tank employs several insulator liners including an air space to provide sufficient insulation from ground to allow the outside of the supply tank to be grounded. A coaxial supply base, having a non-conductive inner tube and a teflon insulated pick-up tube completely insulates the waterborn material from ground. When the waterborn material is completely depleted, the remaining material in the interior of the tank is manually grounded with a probe or automatically by a piston driven ground system.

This invention is not to be limited by the embodiment shown in the drawings and described in the description which is given by way of example and not of limitation, but only in accordance with the scope of the appended claims.

What is claimed is:

1. An electrostatic fluid supply system comprising;

a tank constructed of a conductive material;

a lid for sealing said tank;

insulating means insulating the interior surface of said lid;

an insulating coating on the interior of said tank;

insulating liner means for insulating a fluid in said tank;

an insulated pick-up tube in said tank;

a hose connected to said pick-up tube for delivering said electrostatic fluid to a spray gun;

whereby the external surfaces of said tank are insulated from said electrostatic fluid.

2. The system according to claim 1 wherein said insulating liner means comprises a pair of insulating liners in said tank.

3. The system according to claim 2 wherein said insulating liner means comprises an intermediate liner and an inner liner inserted in said inner liner.

4. The system according to claim 3 wherein said inserted inner liner is constructed to provide an air space between said intermediate liner and the outside of said inner liner for additional insulation.

5. The system according to claim 4 wherein one of said pairs of insulating liners has a lip that wraps around a rim of said tank and is sealed beneath said lid.

6. The system according to claim 5 wherein said inserted inner liner has said lip.

7. The system according to claim 5 wherein said intermediate liner has said lip.

8. The system according to claim 7 including an insulating cover fitting over said inner liner.

9. The system according to claim 8 wherein said cover has a skirt which extends down between said intermediate liner and said inner liner.

10. The system according to claim 9 in which the underside of said lid has an insulating coating.

11. The system according to claim 1 in which said insulated pick-up tube is a Teflon tube having a passageway for receiving an end of said hose.

12. The system according to claim 11 in which said hose is a coaxial hose.

13. The system according to claim 12 in which said coaxial hose is comprised of an interior insulated hose and an outer conductive tubular jacket.

14. The system according to claim 1 including means for grounding the remaining electrostatic fluid in said tank when the electrostatic fluid has been depleted.

15. The system according to claim 14 in which said means for grounding said electrostatic fluid comprises an elongate insulated probe having a conductor at a free end and connected to said conductive tank at an opposite end whereby said probe can be used to manually ground the electrostatic fluid in said tank when said lid is removed.

16. The system according to claim 15 including a grounding resistor in said probe to prevent arcing when said electrostatic fluid is grounded.

17. The system according to claim 14 in which said grounding means comprises a conductor extending from the tip of said pick-up tube out through said lid; a conductive piston in contact with the end of said conductor at the end extending through said lid; and lifting means for lifting said piston out of contact with said conductor when said tank is supplying said electrostatic fluid to a spray gun.

18. The system according to claim 17 in which said lifting means comprises; a passageway connecting said piston to a pressure fitting for applying pressure to the interior of said tank; whereby when pressure is applied to said tank said piston is lifted out of contact with said conductor and grounds said electrostatic fluid when pressure is released.

19. The system according to claim 18 including biasing means biasing said piston into contact with said conductor.

20. The system according to claim 19 in which said biasing means comprises a coil spring behind said piston.

* * * * *